US010292547B2

(12) United States Patent
Mardukhayev et al.

(10) Patent No.: US 10,292,547 B2
(45) Date of Patent: May 21, 2019

(54) TOILET SEAT COVER

(71) Applicants: Jane Mardukhayev, Brooklyn, NY (US); Jack Kadymir, Brooklyn, NY (US)

(72) Inventors: Jane Mardukhayev, Brooklyn, NY (US); Jack Kadymir, Brooklyn, NY (US)

( * ) Notice: Subject to any disclaimer, the term of this patent is extended or adjusted under 35 U.S.C. 154(b) by 0 days.

(21) Appl. No.: 14/323,355

(22) Filed: Jul. 3, 2014

(65) Prior Publication Data

US 2016/0000280 A1 Jan. 7, 2016

(51) Int. Cl.
*A47K 13/18* (2006.01)
*A47K 13/22* (2006.01)

(52) U.S. Cl.
CPC ..... *A47K 13/22* (2013.01); *A47K 13/18* (2013.01)

(58) Field of Classification Search
CPC ..... A47K 13/16; A47K 13/14; A47K 13/145
USPC ..... 4/245.5, 245.1–245.9
See application file for complete search history.

(56) References Cited

U.S. PATENT DOCUMENTS 1,744,300 A * 1/1930 Dewaide ..... A47K 13/16 4/245.9
2,189,562 A * 2/1940 Doerr ..... A47K 17/003 4/245.8
3,967,325 A 7/1976 Rodriguez
4,806,406 A 2/1989 Akerman
4,920,584 A 5/1990 Abdrabbo
4,979,237 A 12/1990 Hazar
5,107,549 A * 4/1992 Pitts ..... A47K 13/145 4/244.2
5,172,431 A 12/1992 Rohde
5,392,469 A * 2/1995 Adams ..... A47K 13/16 4/245.2
5,437,906 A 8/1995 Snuggs
5,557,809 A 9/1996 Adams
5,745,929 A * 5/1998 Sobieralski ..... A47K 13/18 383/207
6,968,578 B2 11/2005 Bernsley
7,254,845 B1 8/2007 Morad
7,328,465 B1 2/2008 Morad
7,356,855 B1 8/2008 Morad
7,506,928 B1 * 3/2009 Meek ..... A47C 31/11 297/229
7,707,661 B2 5/2010 Issachar
8,621,675 B2 1/2014 Aspiro
(Continued)

*Primary Examiner* — Christine J Skubinna
(74) *Attorney, Agent, or Firm* — Lainie E. Parker; Richard M. Blank

(57) ABSTRACT

There is disclosed a toilet seat transparent elastic cover for preventing a user from a direct contact with a toilet seat. The cover includes mark lines to be aligned ensuring a proper placement of the cover. The cover may include an aperture with two lateral edges and a flap located in front of the aperture. The flap is formed by two lateral perforated lines connecting it to corresponding parts of the cover before the user starts using the cover. The perforated lines are extensions of the two lateral edges, such that when the user places the cover on the toilet seat, tears the perforated lines, and moves the flap forward at a desirable length and downward/upward, the aperture is effectively extended, providing an additional convenience to the user. An objective of the cover is to improve its adjustment to the user's body dimensions correspondingly to typical sizes of the seat.

12 Claims, 4 Drawing Sheets

(56) References Cited

U.S. PATENT DOCUMENTS

| | | | | |
|---|---|---|---|---|
| 8,656,523 | B2 | 2/2014 | Vaniakin | |
| 2014/0317837 | A1* | 10/2014 | Chien | A47K 13/16<br>4/245.4 |

* cited by examiner

TOILET SEAT COVER

FIELD OF THE INVENTION

The present invention relates to toilet seat covers, and more particularly to disposable sanitary toilet seat covers.

BACKGROUND OF THE INVENTION

Public restrooms and toilets are not always maintained in satisfactory sanitary conditions. The toilet seats may contain disease-causing bacteria and viruses. That's why it's important to provide sanitary measures for protecting people who use such facilities.

Some restrooms are supplied with toilet seat covers that may be placed on the toilet seat. Examples of patented toilet seat covers can be found in the following U.S. Pat. Nos. 3,967,325; 4,806,406; 4,920,584; 4,979,237; 5,172,431; 5,437,906; 5,557,809; 6,968,578; 7,254,845; 7,328,465; 7,356,855; 7,707,661; 8,656,523; 8,621,675; etc.

For instance, U.S. Pat. No. 7,707,661 teaches: "The present invention discloses a sanitary paper that is designed to be appropriate for dual functions: (1) as a tissue paper for wiping and cleaning by a user, and (2) as a toilet seat-cover. The sanitary paper is a folded continuous sanitary paper strip comprising detachable sections of tissue paper, where some sections are toilet seat-covers which are defined by appropriate transverse seat-cover perforation lines. Various embodiments are described regarding the folding of the sanitary paper strip. A precut bowl flap, in each of the detachable seat-covers, is provided as well. The sanitary paper strip can be made of a single or multi-ply paper. In the preferred embodiment of the present invention, the sanitary paper is made of a duplex paper, where each surface best serves the intended function of that surface. Additionally, the sanitary paper strip can be impregnated with various chemicals."

Another U.S. Pat. No. 4,920,584 teaches: "A sanitary toilet seat cover is formed of a nonporous, nondisintegratable material, such as plastic sheet material, for protecting a user from disease-causing micro-organisms. The toilet seat cover of the present invention has integrally formed therewith a protective flap portion which ensures against contact by any part of the anatomy of the user with the inside of the front of either the commode or the toilet seat itself. In accordance with a manufacturing method aspect of the invention, a plurality of toilet seat covers are produced from a continuous sleeve of the nonporous material. After perforation lines are made in the sleeve to facilitate separation of the individual toilet seat covers, as well as removing a blank central portion and producing the protective flap, the continuous sleeve may be folded so that, after rolling, it can be accommodated on the axle of a dispenser having the dimensions of conventional bathroom tissue."

Though the related art contains numerous designs of toilet seat covers, many of them possess certain disadvantages, such as being complicated and expensive in manufacturing, having difficulties in mounting, having unsatisfactory convenience for the user, etc. The authors of the instant invention have identified another problem related to the use of such toilet seat covers: a limited possibility of adjustment to real dimensions of the user's body correspondingly to typical sizes of the toilet seats. An important object of the instant invention is to find design solutions to the aforementioned problem.

SUMMARY OF THE PRESENT INVENTION

According to a first embodiment of the present invention, there is provided a toilet seat cover for preventing a user from a direct contact with a toilet seat; the toilet seat includes: —an external edge, and —an internal edge defining an opening of the toilet seat; the internal edge defines a rear portion and a front portion thereof; the toilet seat cover is manufactured of an essentially transparent elastic material; the toilet seat cover is capable of being placed by the user on the toilet seat; the toilet seat cover comprises: —a first mark line predeterminedly drawn on the toilet seat cover and capable of being aligned by the user such that the first mark line outwardly encircles the rear portion of the internal edge with a rear gap; —a third mark line predeterminedly drawn on the toilet seat cover and capable of being aligned by the user such that the third mark line outwardly encircles the front portion of the internal edge with a front gap predetermined by the user; and —an elongated aperture provided in a central region of the toilet seat cover; wherein the elongated aperture is located within the opening of the toilet seat as a result of providing the rear gap and the front gap.

According to a second embodiment of the present invention, there is provided a toilet seat cover for preventing a user from a direct contact with a toilet seat; the toilet seat includes: —an external edge, and —an internal edge defining an opening of the toilet seat; the internal edge defines a rear portion and a front portion thereof; the toilet seat cover is manufactured of an essentially transparent elastic material; the toilet seat cover is capable of being placed by the user on the toilet seat; the toilet seat cover comprises: —a first mark line predeterminedly drawn on the toilet seat cover and capable of being aligned by the user such that the first mark line outwardly encircles the rear portion of the internal edge with a rear gap; —a second mark line predeterminedly drawn on the toilet seat cover and capable of being aligned by the user such that the second mark line is located inwardly to the front portion of the internal edge; —a third mark line predeterminedly drawn on the toilet seat cover and capable of being aligned by the user such that the mark line outwardly encircles the front portion of the internal edge with a front gap predetermined by the user; —an elongated aperture provided in a central region of the toilet seat cover, wherein the elongated aperture is located within the opening of the toilet seat as a result of providing the rear gap and the front gap; the elongated aperture further includes two lateral edges and a frontal portion; the toilet seat cover further comprises a flap located in front of the frontal portion of the elongated aperture; wherein: the flap is formed by two lateral perforated lines connecting the flap to corresponding parts of the toilet seat cover before the user starts using the toilet seat cover; the two lateral perforated lines are extensions of the two lateral edges of the elongated aperture, such that when the user places the toilet seat cover on the toilet seat, tears the two lateral perforated lines, and moves the flap forward at a desirable length and downward or upward, the elongated aperture is effectively extended, providing an additional convenience to the user.

According to a third embodiment of the present invention, there is provided a method for using a toilet seat cover for preventing a user from a direct contact with a toilet seat; wherein: the toilet seat includes: an external edge, and an internal edge defining an opening of the toilet seat; the internal edge defines a rear portion and a front portion thereof; the toilet seat cover is manufactured of an essentially transparent elastic material; the toilet seat cover includes: a first mark line predeterminedly drawn on the toilet seat cover; a second mark line predeterminedly drawn on the toilet seat cover; a third mark line predeterminedly drawn on the toilet seat cover; and an elongated aperture provided in a central region of the toilet seat cover; the elongated aperture includes two lateral edges and a frontal portion; and a flap located in front of the frontal portion of the elongated aperture; wherein the flap is formed by two lateral perforated lines connecting the flap to corresponding parts of the toilet seat cover before the user starts using the toilet seat cover; and the two lateral perforated lines are extensions of the two lateral edges of the elongated aperture; the method comprises the steps of: —placing by the user of the toilet seat cover on the toilet seat; —aligning by the user of the first mark line outwardly to the rear portion of the internal edge with a rear gap; —aligning by the user of the second mark line inwardly to the front portion of the internal edge; —aligning by the user of the third mark line outwardly to the front portion of the internal edge with a front gap predetermined by the user; —placing by the user of the elongated aperture within the opening of the toilet seat as a result of providing the rear gap and the front gap; —tearing by the user of the two lateral perforated lines; and —moving by the user of the flap forward at a desirable length and downward or upward, extending the elongated aperture, and thereby providing an additional convenience to the user.

According to a fourth preferred embodiment, the toilet seat covers of the first embodiment or of the second embodiment can be compactly arranged in a roll comprising a plurality of such toilet seat covers, wherein each neighboring pair of the toilet seat covers is coupled, for instance, by perforated lines or otherwise. The roll can be put on an axle inserted into a stationary housing, which housing might be mounted on a wall of the restroom or in another convenient place.

PREFERRED EMBODIMENTS OF THE PRESENT INVENTION

Figure 1:
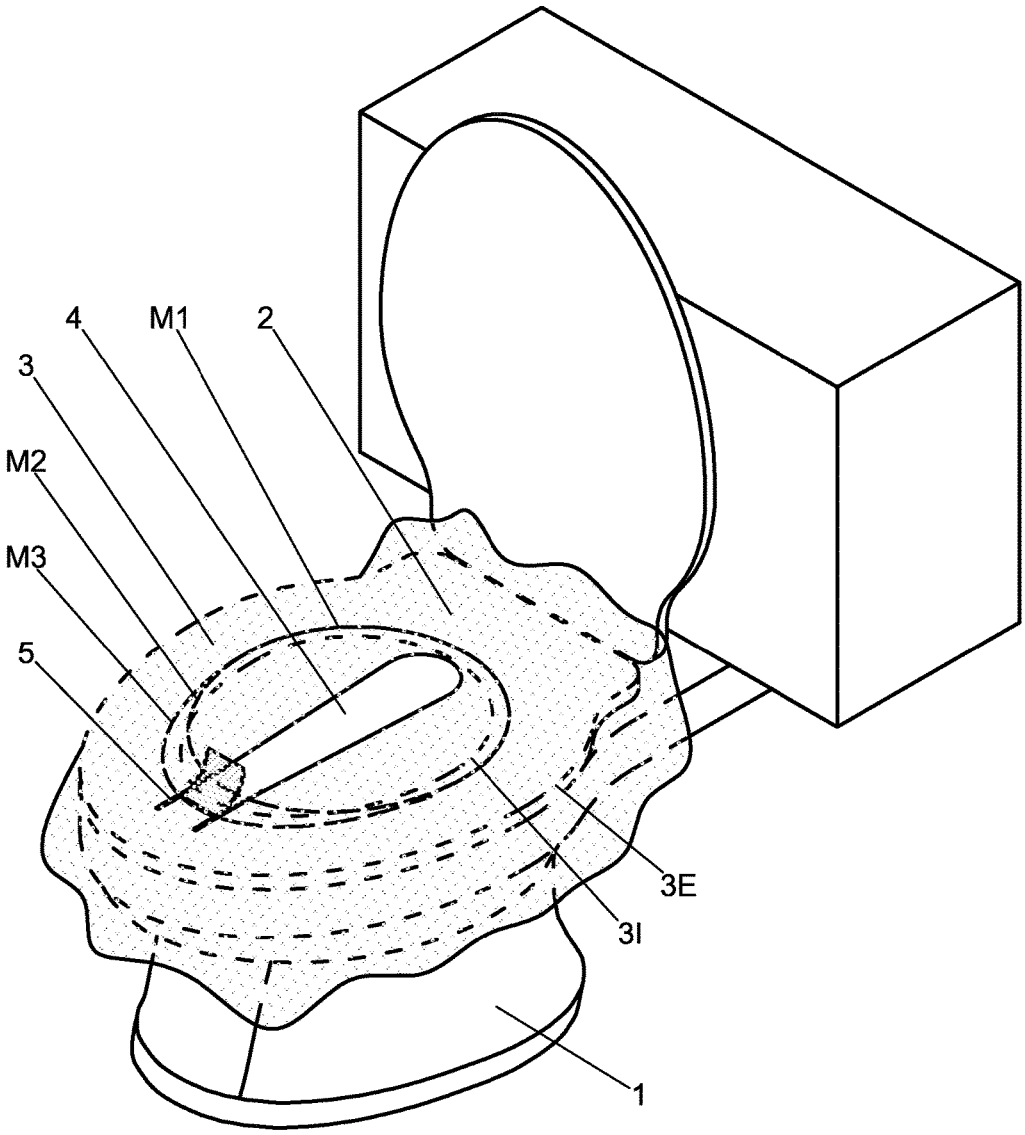
FIG. 1 illustrates a perspective view of a toilet with a toilet seat and a toilet seat cover, according to a preferred embodiment of the present invention.

While the invention may be susceptible to embodiment in different forms, there is shown in the drawings, and will be described in detail herein, specific embodiments of the present invention, with the understanding that the present disclosure is to be considered an exemplification of the principles of the invention, and is not intended to limit the invention to that as illustrated and described herein.

Figure 2:
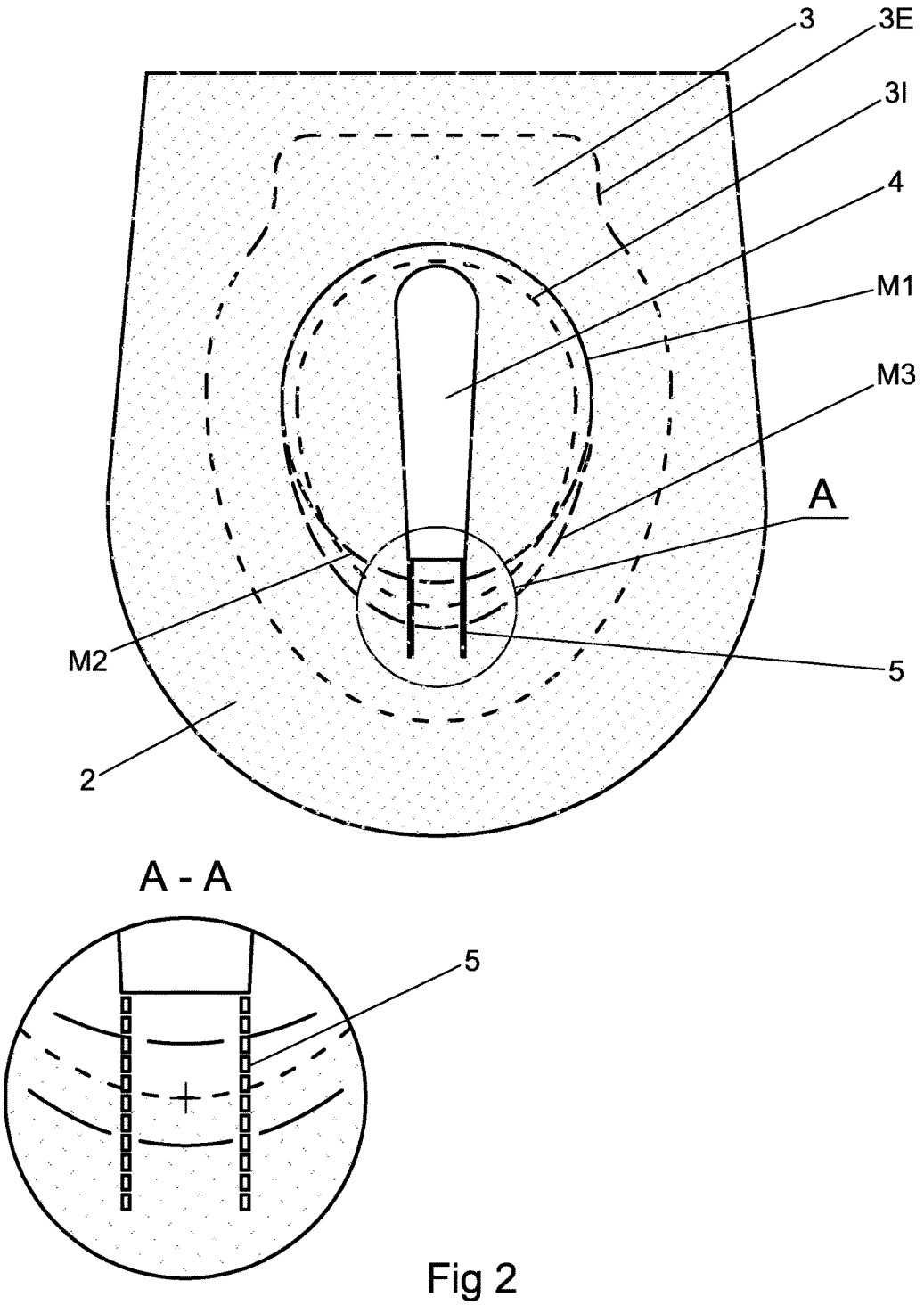
FIG. 2 illustrates a plan view of the toilet seat cover, according to the embodiment of the present invention shown on FIG. 1.
Figure 3:
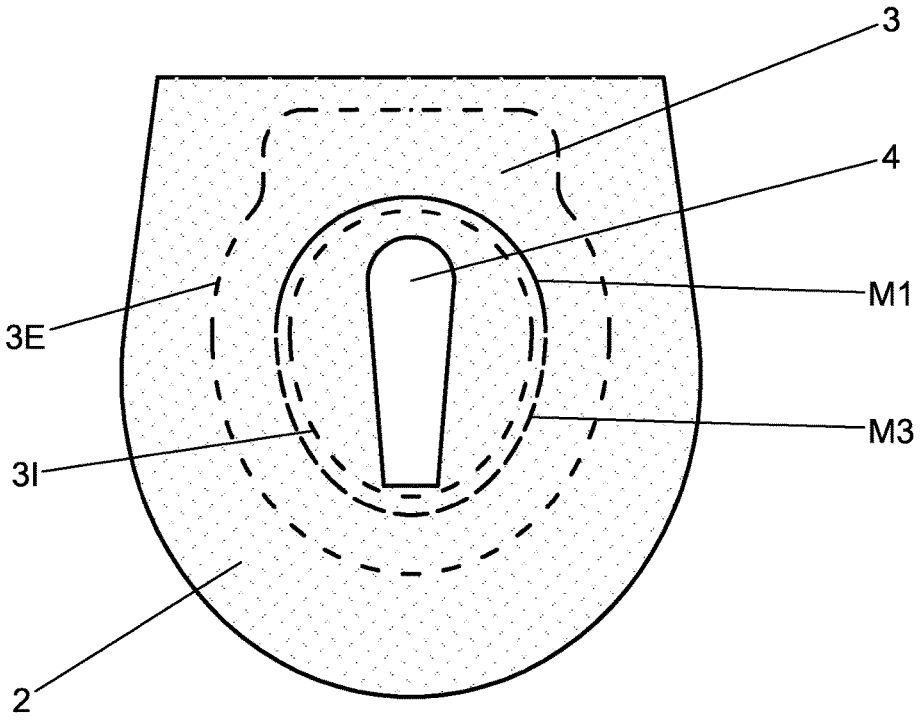
FIG. 3 illustrates a plan view of a toilet seat cover, according to another embodiment of the present invention.

A first preferred embodiment of the invention is illustrated on FIG. 3, and a second preferred embodiment of the invention is illustrated on FIGS. 1 and 2.

According to a first embodiment of the present invention (FIG. 3), there is provided a toilet seat cover (2) for preventing a user from a direct contact with a toilet seat (3) mounted on a toilet (shown in FIG. 1). The toilet seat (3) includes: —an external edge (3E), and —an internal edge (3I) defining an opening of said toilet seat (3); the internal edge (3I) defines a rear portion and a front portion thereof. The toilet seat cover (2) is manufactured of an essentially transparent elastic material. The user can place the toilet seat cover (2) on the toilet seat (3).

The toilet seat cover (2) comprises: —a mark line (M1) predeterminedly drawn on the toilet seat cover (2) and capable of being aligned by the user such that the mark line (M1) outwardly encircles the rear portion of the internal edge (3I) with a rear gap; —a mark line (M3) predeterminedly drawn on the toilet seat cover (2) and capable of being aligned by the user such that the mark line (M3) outwardly encircles the front portion of the internal edge (3I) with a front gap predetermined by the user; and —an elongated aperture (4) provided in a central region of the toilet seat cover (2). The elongated aperture (4) is located within the opening of the toilet seat (3) as a result of providing the rear gap and the front gap.

According to a second preferred embodiment of the present invention (FIGS. 1-2), there is provided a toilet seat cover (2) for preventing a user from a direct contact with a toilet seat (3) mounted on a toilet (1). The toilet seat (3) includes: —an external edge (3E), and —an internal edge (3I) defining an opening of the toilet seat (3); said internal edge (3I) defines a rear portion and a front portion thereof. The toilet seat cover (2) is manufactured of an essentially transparent elastic material. The user can place the toilet seat cover (2) on the toilet seat (3) so that the periphery of the toilet seat cover (2) hangs around the toilet (1).

The toilet seat cover (2) comprises: —a mark line (M1) predeterminedly drawn on the toilet seat cover (2) and capable of being aligned by the user such that the mark line (M1) outwardly encircles the rear portion of said internal edge (3I) with a rear gap; —a mark line (M2) predeterminedly drawn on the toilet seat cover (2) and capable of being aligned by the user such that the mark line (M2) is located inwardly to the front portion of the internal edge (3I); —a mark line (M3) predeterminedly drawn on the toilet seat cover (2) and capable of being aligned by the user such that the mark line (M3) outwardly encircles the front portion of the internal edge (3I) with a front gap predetermined by the user; and —an elongated aperture (4) provided in a central region of the toilet seat cover (2). The elongated aperture (4) is located within the opening of the toilet seat (3) as a result of providing the rear gap and said front gap.

Furthermore, according to the second embodiment of the present invention (FIGS. 1-2), the elongated aperture (4) includes two lateral edges and a frontal portion. The toilet seat cover (2) further comprises a flap (5) located in front of the frontal portion of the elongated aperture (4). The flap (5) is formed by two lateral perforated lines connecting the flap (5) to corresponding parts of said toilet seat cover (2) before the user starts using the toilet seat cover (2). The two lateral perforated lines are extensions of the two lateral edges of the elongated aperture (4), such that when the user places the toilet seat cover (2) on the toilet seat (3), tears the two lateral perforated lines, and moves the flap (5) forward at a desirable length and downward, or forward at a desirable length and upward, the elongated aperture (4) is effectively extended, providing an additional convenience to the user.

According to a third embodiment of the present invention (FIGS. 1-2), there is provided a method for using a toilet seat cover (2) for preventing a user from a direct contact with a toilet seat (3). The toilet seat (3) includes: an external edge (3E), and an internal edge (3I) defining an opening of the toilet seat (3). The internal edge (3I) defines a rear portion and a front portion of the internal edge.

The toilet seat cover (2) is manufactured of an essentially transparent elastic material. The toilet seat cover (2) includes: a mark line (M1) predeterminedly drawn on the toilet seat cover (2); a mark line (M2) predeterminedly drawn on the toilet seat cover (2); a mark line (M3) predeterminedly drawn on the toilet seat cover (2); and an elongated aperture (4) provided in a central region of the toilet seat cover (2). The elongated aperture (4) includes two lateral edges and a frontal portion. The toilet seat cover (2) includes a flap (5) located in front of the frontal portion of the elongated aperture (4). The flap (5) is formed by two lateral perforated lines connecting the flap (5) to corresponding parts of the toilet seat cover (2) before the user starts using the toilet seat cover (2). The two lateral perforated lines are extensions of the two lateral edges of the elongated aperture (4).

According to a third embodiment of the present invention, a method for using a toilet seat cover comprises the steps of: —placing by the user of the toilet seat cover (2) on the toilet seat (3); —aligning by the user of the mark line (M1) outwardly to the rear portion of the internal edge (3I) with a rear gap; —aligning by the user of the mark line (M2) inwardly to the front portion of the internal edge (3I); —aligning by the user of the mark line (M3) outwardly to the front portion of the internal edge (3I) with a front gap predetermined by the user; —placing by the user of the elongated aperture (4) within the opening of the toilet seat (3) as a result of providing the rear gap and the front gap; —tearing by the user of the two lateral perforated lines; and —moving by the user of the flap (5) forward at a desirable length and downward, or forward at a desirable length and upward, extending the elongated aperture (4), and thereby providing an additional convenience to the user.

Figure 4:
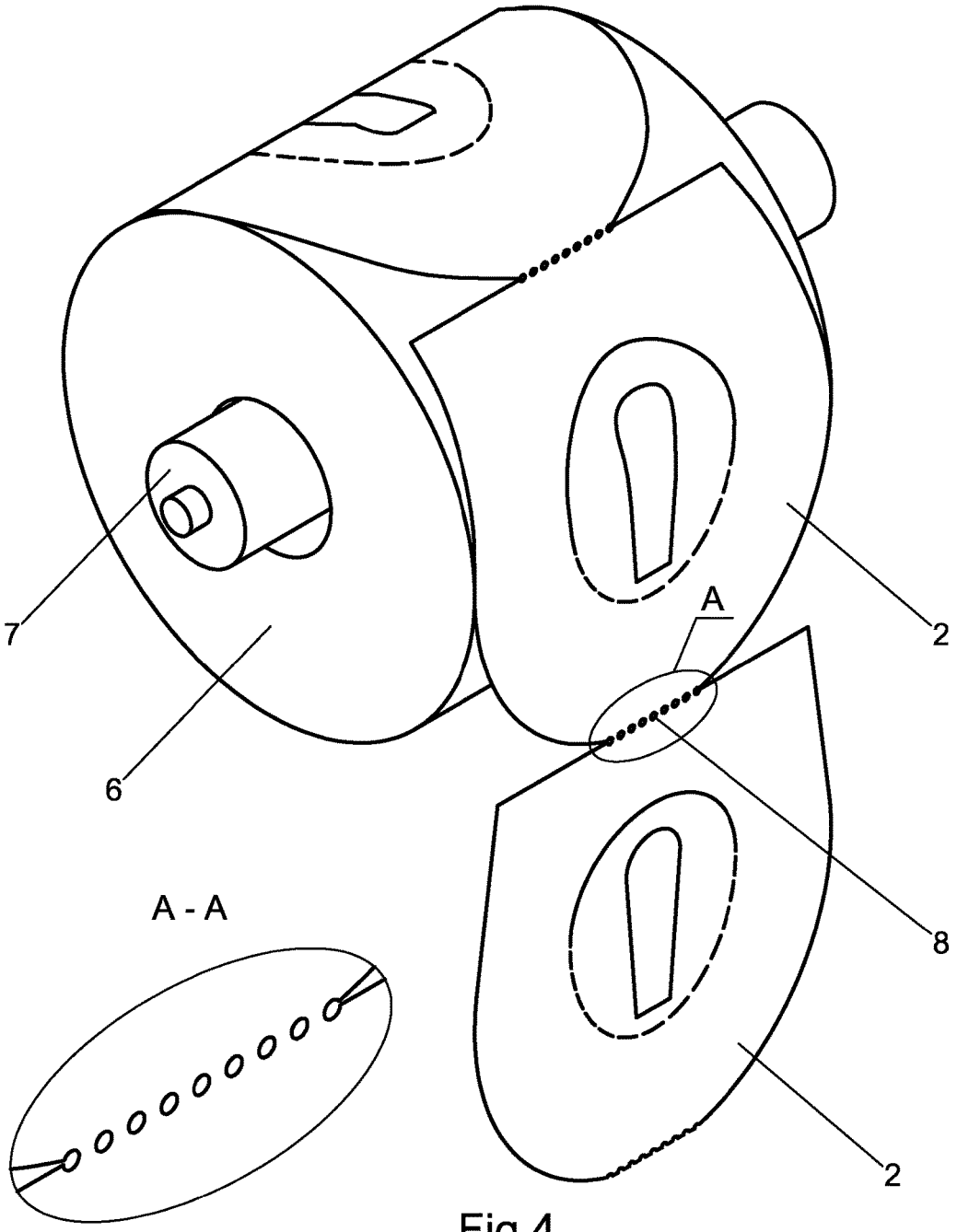
FIG. 4 illustrates a perspective view of a roll of a plurality of toilet seat covers, according to the embodiment of the present invention shown on FIG. 1.

According to a fourth preferred embodiment of the present invention, the toilet seat covers of the first embodiment or of the second embodiment can be compactly arranged in a roll (shown in FIG. 4) comprising a plurality of such toilet seat covers (2), wherein each neighboring pair of the toilet seat covers (2) is coupled by perforated lines (8). The roll is put on an axle (6) inserted into a stationary housing (7), which housing might be mounted on a wall of the restroom. The user can tear the perforated line (8) to obtain one single toilet seat cover (2).

Those skilled in the art will appreciate that the conception, upon which this disclosure is based, may readily be utilized as a basis for the designing of other structures and methods for carrying out several purposes of the present invention. It is therefore important that the claims be regarded as including such equivalent constructions insofar as they do not depart from the spirit and scope of the present invention. As opposed to the claims, the abstract is neither intended to define the invention of the instant application, which is measured by the claims, nor is it intended to be limiting as to the scope of the invention in any way.

What is claimed:

1. A toilet seat cover for preventing a user from direct contact with a toilet seat, the toilet seat having an external edge and an internal edge, the internal edge defining an opening of the toilet seat, and the internal edge having a rear portion and a front portion, the toilet seat cover comprising:

an essentially transparent elastic material;

the toilet seat cover additionally comprising:

at least one mark line predeterminedly drawn on the toilet seat cover and capable of being aligned by the user, at least one of at least one such mark lines being a mark line (M1) that outwardly encircles the rear portion of the internal edge of the toilet seat;

at least one other mark line predetermindly drawn on the toilet seat cover and capable of being aligned by the user, at least one of at least one such mark lines being a mark line (M2) that outwardly encircles the front portion of said internal edge with a front gap predetermined by the user; and an elongated aperture provided in a central region of the toilet seat cover wherein said elongated aperture is capable of being located within the opening of said toilet seat; and wherein said elongated aperture further includes two lateral edges and a frontal portion; and said toilet seat cover further comprises a flap located in front of the frontal portion of said elongated aperture; and wherein:

the flap is formed by two lateral perforated lines connecting said flap to corresponding parts of said toilet seat cover before the user starts using the toilet seat cover; said two lateral perforated lines are extensions of said two lateral edges of the elongated aperture, such that when the user places the toilet seat cover on the toilet seat, tears the two lateral perforated lines, and moves the flap forward at a desirable length and downward, or moves the flap forward at a desirable length and upward, said elongated aperture is effectively extended, providing an additional convenience to the user.

2. A toilet seat cover for preventing a user from direct contact with a toilet seat, the toilet seat having an external edge and an internal edge, the internal edge defining an opening of the toilet seat, and the internal edge having a rear portion and a front portion, the toilet seat cover comprising:

an essentially transparent elastic material;

said toilet seat cover additionally comprising:

a mark line (M1) predeterminedly drawn on the toilet seat cover and capable of being aligned by the user such that said mark line (M1) outwardly encircles the rear portion of said internal edge with a rear gap;

a mark line (M2) predeterminedly drawn on the toilet seat cover and capable of being aligned by the user such that said mark line (M2) is located inwardly to the front portion of said internal edge;

a mark line (M3) predeterminedly drawn on the toilet seat cover and capable of being aligned by the user such that said mark line (M3) outwardly encircles the front portion of said internal edge with a front gap predetermined by the user; and an elongated aperture provided in a central region of the toilet seat cover; wherein said elongated aperture:

is capable of being located within the opening of said toilet seat because of providing said rear gap and said front gap;

said elongated aperture further including two lateral edges and a frontal portion; and said toilet seat cover further comprising a flap located in front of the frontal portion of said elongated aperture: and wherein:

the flap is formed by two lateral perforated lines connecting said flap to corresponding parts of said toilet seat cover before the user starts using the toilet seat cover; said two lateral perforated lines are extensions of said two lateral edges of the elongated aperture, such that when the user places the toilet seat cover on the toilet seat, tears the two lateral perforated lines, and moves the flap forward at a desirable length and downward, or moves the flap forward at a desirable length and upward, said elongated aperture is effectively extended, providing an additional convenience to the user.

3. A method for using a toilet seat cover for preventing a user from direct contact with a toilet seat, wherein:

said toilet seat includes: an external edge, an internal edge defining an opening of said toilet seat; and said internal edge having a rear portion and a front portion;

said toilet seat cover is an essentially transparent elastic material;

said toilet seat cover includes: a mark line (M1) predeterminedly drawn on said toilet seat cover; a mark line (M2) predeterminedly drawn on said toilet seat cover; a mark line (M3) predeterminedly drawn on said toilet seat cover;

an elongated aperture in a central region of the toilet seat cover, the elongated aperture including two lateral edges and a frontal portion; and a flap located in front of the frontal portion of said elongated aperture;

and wherein the flap is formed by two lateral perforated lines connecting said flap to corresponding parts of said toilet seat cover before the user starts using the toilet seat cover; and said two lateral perforated lines are extensions of said two lateral edges of the elongated aperture;

said method comprising the steps of:

placing by the user of the toilet seat cover on the toilet seat;

aligning by the user of mark line (M1) outwardly to the rear portion of said internal edge with a rear gap;

aligning by the user of said mark line (M2) inwardly to the front portion of said internal edge;

aligning by the user of said mark line (M3) outwardly to the front portion of said internal edge with a front gap predetermined by the user;

placing by the user of said elongated aperture within the opening of said toilet seat;

tearing by the user of the two lateral perforated lines; whereby the flop is used by user to adjust length of the toilet seat cover gap opening to the toilet bowl and moving by the user of the flap forward at a desirable length and downward, or moving by the user of the flap forward at a desirable length and upward, thereby extending said elongated aperture, and providing an additional convenience to the user.

4. The toilet seat cover of claim 1 wherein the elongated aperture is elongated and narrow.

5. The toilet seat cover of claim 1, wherein the toilet seat cover has at least three mark lines, at least two of the mark lines are dotted lines and at least one of the mark lines is a solid line; the mark lines help the user align the cover with the opening of the toilet seat.

6. A toilet seat cover for preventing a user from direct contact with a toilet seat, the toilet seat having an external edge and an internal edge, the internal edge defining an opening of the toilet seat, and the internal edge having a rear portion and a front portion, the toilet seat cover comprising:

an essentially transparent elastic material;

said toilet seat cover additionally comprising:

at least one mark line predeterminedly drawn on the toilet seat cover and capable of being aligned by the user, at least one of at least one such mark lines being a mark line (M1) that outwardly encircles the rear portion of said internal edge with a rear gap;

at least one mark line predeterminedly drawn on the toilet seat cover and capable of being aligned by the user, at least one of at least one such mark lines being a mark line (M3) that outwardly encircles the front portion of said internal edge with a front gap predetermined by the user; and an elongated aperture provided in a central region of the toilet seat cover wherein said elongated aperture is capable of being located within the opening of said toilet seat because of providing said rear gap and said front gap; and wherein said elongated aperture further includes two lateral edges and a frontal portion; and said toilet seat cover further comprises a flap located in front of the frontal portion of said elongated aperture; and wherein:

the flap is formed by two lateral perforated lines connecting said flap to corresponding parts of said toilet seat cover before the user starts using the toilet seat cover; said two lateral perforated lines are extensions of said two lateral edges of the elongated aperture, such that when the user places the toilet seat cover on the toilet seat, tears the two lateral perforated lines, and moves the flap forward at a desirable length and downward, or moves the flap forward at a desirable length and upward, said elongated aperture is effectively extended, providing an additional convenience to the user;

the elongated aperture is elongated and narrow.

7. A toilet seat cover for preventing a user from direct contact with a toilet seat, the toilet seat having an external edge and an internal edge, the internal edge defining an opening of the toilet seat, and the internal edge having a rear portion and a front portion, the toilet seat cover comprising:

an essentially transparent elastic material;

said toilet seat cover additionally comprising:

a mark line (M1) predeterminedly drawn on the toilet seat cover and capable of being aligned by the user such that said mark line (M1) outwardly encircles the rear portion of said internal edge with a rear gap;

a mark line (M3) predeterminedly drawn on the toilet seat cover and capable of being aligned by the user such that said mark line (M3) outwardly encircles the front portion of said internal edge with a front gap predetermined by the user; and an elongated aperture provided in a central region of the toilet seat cover wherein said elongated aperture is capable of being located within the opening of said toilet seat because of providing said rear gap and said front gap; and wherein said elongated aperture further includes two lateral edges and a frontal portion; and said toilet seat cover further comprises a flap located in front of the frontal portion of said elongated aperture;

and wherein:

the flap is formed by two lateral perforated lines connecting said flap to corresponding parts of said toilet seat cover before the user starts using the toilet seat cover; said two lateral perforated lines are extensions of said two lateral edges of the elongated aperture, such that when the user places the toilet seat cover on the toilet seat, tears the two lateral perforated lines, and moves the flap forward at a desirable length and downward, or moves the flap forward at a desirable length and upward, said elongated aperture is effectively extended, providing an additional convenience to the user;

and wherein at least one of mark line (M1) and mark line (M2) is a dotted line, at least one of mark line (M1) and mark line (M2) is a solid line, and further comprising at least one more mark line (M3) which is a dotted line, the mark lines help the user align the cover with the opening of the toilet seat.

8. A toilet seat cover for preventing a user from direct contact with a toilet seat, the toilet seat having an external edge and an internal edge, the internal edge defining an opening of the toilet seat, and the internal edge having a rear portion and a front portion, the toilet seat cover comprising:

an essentially transparent elastic material;

said toilet seat cover additionally comprising:

a mark line (M1) predeterminedly drawn on the toilet seat cover and capable of being aligned by the user such that said mark line (M1) outwardly encircles the rear portion of said internal edge with a rear gap;

a mark line (M3) predeterminedly drawn on the toilet seat cover and capable of being aligned by the user such that said mark line (M3) outwardly encircles the front portion of said internal edge with a front gap predetermined by the user; and an elongated aperture provided in a central region of the toilet seat cover wherein said elongated aperture is capable of being located within the opening of said toilet seat because of providing said rear gap and said front gap; and wherein said elongated aperture further includes two lateral edges and a frontal portion; and said toilet seat cover further comprises a flap located in front of the frontal portion of said elongated aperture;

and wherein:

the flap is formed by two lateral perforated lines connecting said flap to corresponding parts of said toilet seat cover before the user starts using the toilet seat cover; said two lateral perforated lines are extensions of said two lateral edges of the elongated aperture, such that when the user places the toilet seat cover on the toilet seat, tears the two lateral perforated lines, and moves the flap forward at a desirable length and downward, or moves the flap forward at a desirable length and upward, said elongated aperture is effectively extended, providing an additional convenience to the user;

the elongated aperture is elongated and narrow;

and wherein at least one of mark line (M1) and mark line (M3) is a dotted line, at least one of mark line (M1) and mark line (M3) is a solid line, and further comprising at least one more mark line (M2) which is a dotted line, the mark lines help the user align the cover with the opening of the toilet seat.

9. A toilet seat cover for preventing a user from direct contact with a toilet seat, the toilet seat having an external edge and an internal edge, the internal edge defining an opening of the toilet seat, and the internal edge having a rear portion and a front portion, the toilet seat cover comprising:

an essentially transparent elastic material;

said toilet seat cover additionally comprising:

a mark line (M1) predeterminedly drawn on the toilet seat cover and capable of being aligned by the user such that said mark line (M1) outwardly encircles the rear portion of the internal edge of the said toilet seat;

a mark line (M3) predeterminedly drawn on the toilet seat cover and capable of being aligned by the user such that said mark line (M3) outwardly encircles the front portion of said internal edge with a front gap predetermined by the user;

and an elongated aperture provided in a central region of the toilet seat cover wherein said elongated aperture is capable of being located within the opening of said toilet seat; and wherein said elongated aperture further includes two lateral edges and a frontal portion; and said toilet seat cover further comprises a flap located in front of the frontal portion of said elongated aperture;

and wherein:

the flap is formed by two lateral perforated lines connecting said flap to corresponding parts of said toilet seat cover before the user starts using the toilet seat cover; said two lateral perforated lines are extensions of said two lateral edges of the elongated aperture, such that when the user places the toilet seat cover on the toilet seat, tears the two lateral perforated lines, and moves the flap forward at a desirable length and downward, or moves the flap forward at a desirable length and upward, said elongated aperture is effectively extended, providing an additional convenience to the user.

10. A toilet seat cover for preventing a user from direct contact with a toilet seat, the toilet seat having an external edge and an internal edge, the internal edge defining an opening of the toilet seat, and the internal edge having a rear portion and a front portion, the toilet seat cover comprising:

an essentially transparent elastic material;

said toilet seat cover comprising:

a mark line (M1) predeterminedly drawn on the toilet seat cover and capable of being aligned by the user such that said mark line (M1) outwardly encircles the rear portion of the said internal edge of the said toilet seat;

a mark line (M3) predeterminedly drawn on the said toilet seat cover and capable of being aligned by the user such that said mark line (M3) outwardly encircles the front portion of said internal edge with a front gap predetermined by the user;

and an elongated aperture provided in a central region of the toilet seat cover wherein said elongated aperture is capable of being located within the opening of said toilet seat;

and wherein said elongated aperture further includes two lateral edges and a frontal portion; and said toilet seat cover further comprises a flap located in front of the frontal portion of said elongated aperture; and wherein:

the flap is formed by two lateral perforated lines connecting said flap to corresponding parts of said toilet seat cover before the user starts using the toilet seat cover; said two lateral perforated lines are extensions of said two lateral edges of the elongated aperture, such that when the user places the toilet seat cover on said toilet seat, tears the two lateral perforated lines, and moves the flap forward at a desirable length and downward, or moves the flap forward at a desirable length and upward, said elongated aperture is effectively extended, providing an additional convenience to the user.

11. The toilet seat cover of claim 1, wherein when the rear straight line markings of the toilet seat cover and the front dotted line markings of the toilet seat cover are in line with the corresponding inner portion of the toilet seat, the toilet seat cover opening is in the proper place centered in the open ambient, and wherein said front dotted line markings are at least two dotted lines each for fitting and lining up to a different size toilet bowl seat.

12. The toilet seat cover of claim 1, wherein the length of the flap is adjustable to adjust the length of the elongated aperture in the toilet seat cover as is convenient, based on the size of the user and/or the toilet seat.

* * * * *